US005990458A

United States Patent [19]

Hyllberg et al.

[11] Patent Number: 5,990,458

[45] Date of Patent: Nov. 23, 1999

[54] END CAP CONTACT ASSEMBLY FOR A HEATER ROLLER

[75] Inventors: Bruce E. Hyllberg, Gurnee, Ill.; Robert G. Langley, Burlington, Wis.

[73] Assignee: American Roller Company, Union Grove, Calif.

[21] Appl. No.: 09/033,815

[22] Filed: Mar. 3, 1998

[51] Int. Cl.[6] ..... B21B 27/06; G03G 15/20; H01R 13/33; H05B 3/03

[52] U.S. Cl. ..... 219/469; 219/216; 439/29; 439/799; 439/840

[58] Field of Search ..... 219/216, 469, 219/471, 541, 543; 338/376; 439/21, 25, 29, 788, 799, 840

[56] References Cited

U.S. PATENT DOCUMENTS

| | | | |
|---|---|---|---|
| 1,668,381 | 5/1928 | Schlid | 439/840 |
| 3,056,101 | 9/1962 | Bethke | 439/21 |
| 4,033,654 | 7/1977 | Ross | 439/840 |
| 4,321,759 | 3/1982 | Gamble | 34/110 |
| 4,570,055 | 2/1986 | McMills | 219/541 |
| 4,820,904 | 4/1989 | Urban | 219/216 |
| 5,191,381 | 3/1993 | Yuan | 219/216 |
| 5,235,163 | 8/1993 | Levitan | 219/541 |
| 5,532,807 | 7/1996 | Takemoto | 219/216 |
| 5,616,263 | 4/1997 | Hyllberg | 219/469 |
| 5,726,425 | 3/1998 | Moebius | 219/471 |
| 5,821,499 | 10/1998 | Crimmins et al. | 219/471 |

FOREIGN PATENT DOCUMENTS

| | | |
|---|---|---|
| 0 687 132 A2 | 6/1995 | European Pat. Off. . |
| WO 96/31088 | 3/1996 | WIPO . |

*Primary Examiner*—Joseph Pelham
*Attorney, Agent, or Firm*—Quarles & Brady LLP

[57] ABSTRACT

An electrical contact assembly for a roller (10) having at least one single-bevel end portion (13) has a first electrical contact formed by a thermally sprayed band (29) of a nickel alloy, a second electrical contact (30) formed by an annular contact structure (57, 37, 38, 30) assembled to the roller (10) and a bridging contact formed by an extension coil spring (33) which extends around the tapered end (24) of the roller (10) in a location where it will make bridging contact between the first electrical contact (29) and the second electrical contact (30) and provide spring pressure to maintain such contact.

27 Claims, 4 Drawing Sheets

FIG. 2
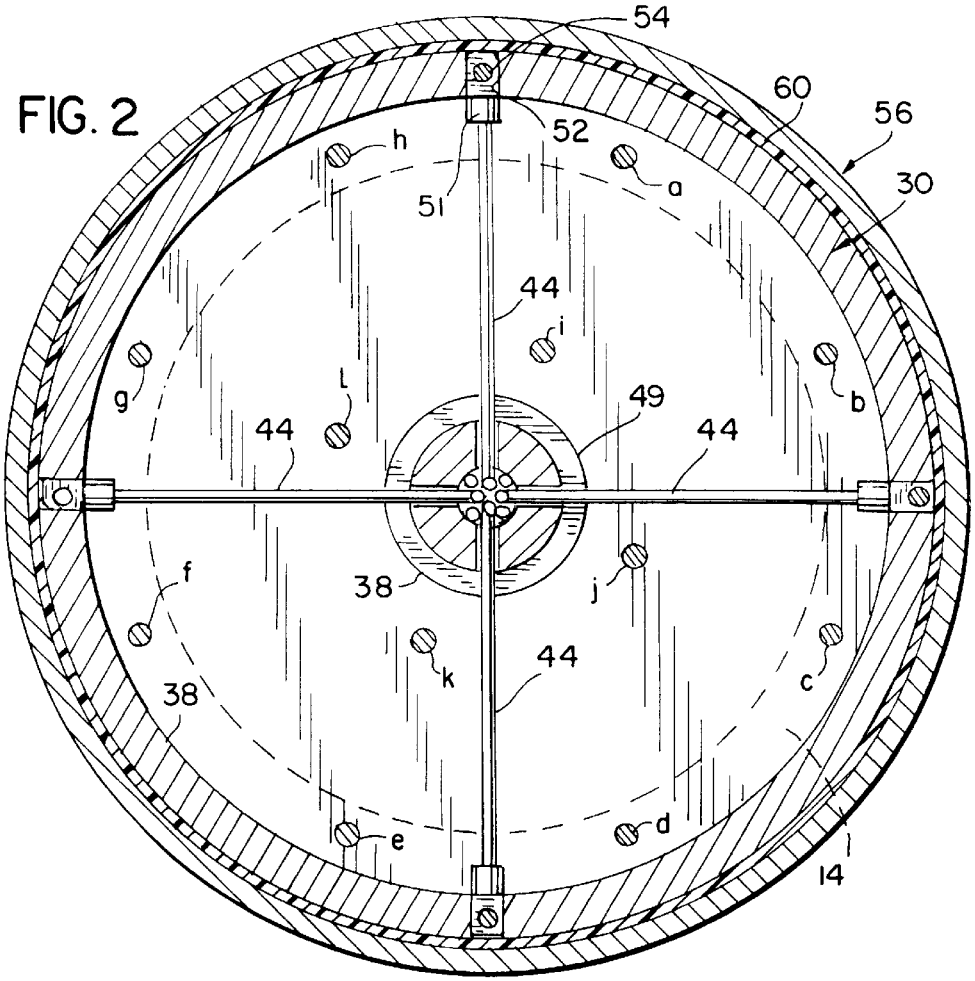
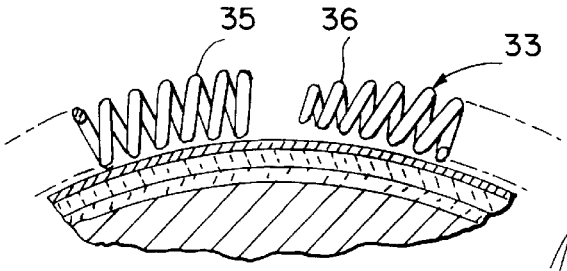
FIG. 5
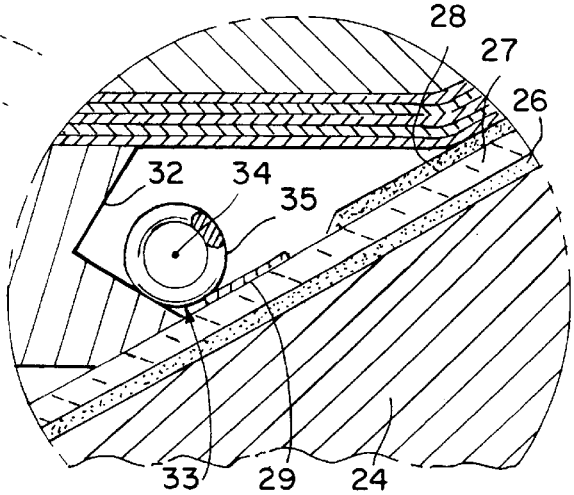
FIG. 4

END CAP CONTACT ASSEMBLY FOR A HEATER ROLLER

TECHNICAL FIELD

The invention relates to contact assemblies for use in heating rollers.

BACKGROUND ART

In recent years a new type of ceramic heater roller, as disclosed in U.S. Pat. No. 5,616,263, has been developed for use instead of steam-heated, oil-heated and induction-heated rollers in the papermaking, printing, and the paper, film, and foil converting industries. Such rollers have been used as web heating rollers, drying rollers and drums, laminating rollers, embossing rollers, and cast film extrusion rollers.

These rollers operate in machines in which electrical connections must be made to the roller. In a prior published PCT patent document WO 96/31088, based on a prior U.S. application Ser. No. 08/414,430, an electrical contact assembly used a metal contact which directly contacted a conductive layer that extended down a tapered end of the roller. The end of the roller included a double bevel or double taper construction, a first O-ring which was located above the contact region, and a second O-ring which was located below the contact region, to seal the contact region against contaminants and fouling due to the formation of oxides.

The prior construction required contact pressure, and precise alignment and fit between the contact and the band on the roller. The O-rings also required some careful handling during assembly for proper fit and operation. The entire assembly had numerous parts which involved cost in manufacture and assembly. The prior construction also used the "double bevel" form of tapered roller ends, which are more difficult to manufacture and maintain against cracks in the ceramic layers of the roller than a single bevel construction.

The present invention is directed to improved constructions of electrical contact assemblies for use with ceramic heater rollers.

SUMMARY OF THE INVENTION

The invention relates to an electrical contact assembly for a roller having a heating layer in which an electrical circuit is formed through said heating layer from an external power supply.

The electrical contact assembly includes a first electrical contact formed on a tapered end portion of the roller, a second electrical contact formed on an electrode ring and an elastic bridging contact formed by a stretchable elastic member that extends around the tapered end portion of the roller in a location where it will contact both the first and second electrical contacts.

In a preferred embodiment, the stretchable elastic member is a coiled spring which provides sufficient contact area and contact pressure to maintain the electrical contact, while also providing some elasticity to the contact region to avoid areas of non-contact and misalignment. In a preferred embodiment, the first and second contacts are spaced apart, but this is not strictly required as the coiled spring provides a mechanical pressure interface between the first and second electrical contacts which is more significant and reliable than direct contact between the two contacts. Nevertheless, this contact assembly also provides advantages in the electrical interface in extending around the roller to provide many areas of contact, and the spring exhibits consistent mechanical performance over time and temperature of operation.

The preferred angle of bevel for the tapered end portion is approximately thirty degrees, although the invention can be used in rollers having taper angles from about five to about eighty-five degrees.

The invention provides a new insulating component, a Teflon-coated tape, which is positioned between the outer end cap and the inner parts of the end cap assembly. The use of this tape provides a soft seal between the outer end cap and the ceramic surface that is an improvement over the use of O-rings shown in the prior art. Because the physical size of the electrified components is much smaller than the prior art design, it is much easier to provide adequate electrical insulation for high operating voltages.

Other objects and advantages, besides those discussed above, will be apparent to those of ordinary skill in the art from the description of the preferred embodiment which follows. In the description, reference is made to the accompanying drawings, which form a part hereof, and which illustrate examples of the invention. Such examples, however, are not exhaustive of the various embodiments of the invention, and, therefore, reference is made to the claims which follow the description for determining the scope of the invention.

BRIEF DESCRIPTION OF THE DRAWINGS

FIG. 2 is a cross sectional view taken in the plane indicated by line 2—2 in FIG. 1;

FIG. 4 is an enlarged, detail view of a portion of FIG. 3 indicated by line 4—4 in FIG. 3;

FIG. 5 is a detail view of a spring seen in FIGS. 3 and 4; and

DETAILED DESCRIPTION OF THE PREFERRED EMBODIMENT

FIGS. 1–6 show a preferred embodiment of a contact assembly for use in a ceramic heater roller 10 for industrial applications for the papermaking, printing, and the paper, film, and foil converting industries. The invention may also be applicable to fuser rollers of the type used in printing and copying machines for handling of toner or dry ink.

The roller 10 preferably has a metal core 11, 12, 13, 14 (FIG. 1) which may be steel, stainless steel, brass or aluminum. The core may also be made of other types of materials, including electrically insulating materials such as glass or composites. The primary requirements of the core material are strength, the ability to machine or otherwise shape the core and to provide holes for fasteners to be described, and the ability to handle heat transfer and pressure in the event that the core is evacuated or that some type of heat pipe is employed to assist heating.

A cover 18 (FIG. 1) is disposed around the core 11, 12, 13 and 14. The cover 18 is more particularly formed of several layers which will be described below in relation to FIGS. 3, 4 and 5.

Figure 1:
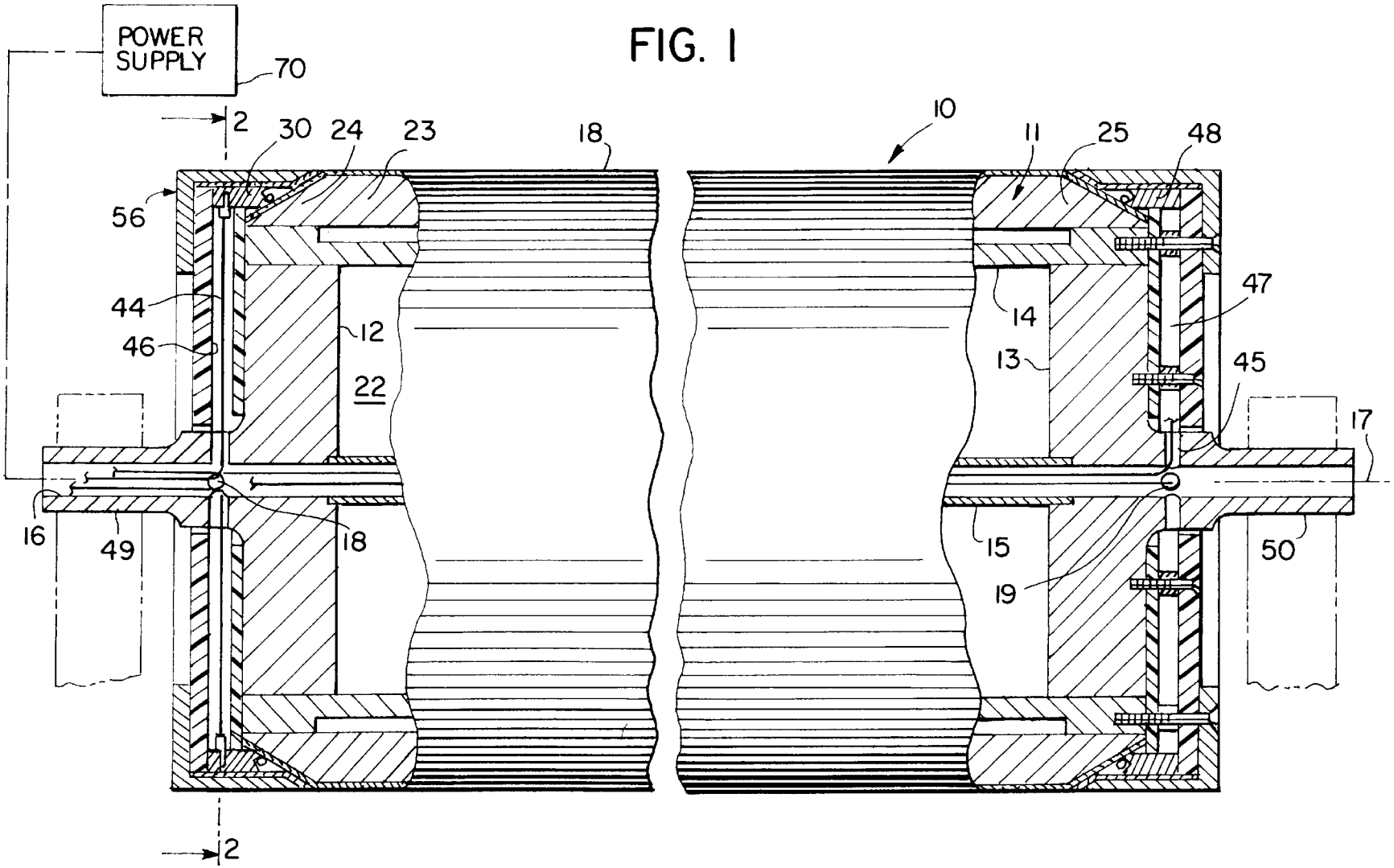
FIG. 1 is a longitudinal section of a first embodiment of a roller with an end cap assembly of the present invention.

As shown in FIGS. 1 and 2, the core includes end pieces 12, 13, which form end plugs for a tubular member 14 that encloses central cavity 22. An outer sleeve member 11 fits over tubular member 14 to complete the core. Between the tubular member 14 and the outer sleeve member 11 is an integral heat pipe 21 as disclosed in copending U.S. application Ser. No. 08/783,597, filed Jan. 17, 1997. An axial sleeve member 15 is mounted in between the end pieces 12, 13 to complete a central passageway 16 along a roller axis 17. The end pieces 12, 13 form end journal shafts 49, 50 and also include radially extending bores 18 and 19 for passage of wires 44, 45 into the central bore 16. The radially extending bores 18 are provided in sets of four, each set including four bores 18, 19, spaced 90° apart and around journal shafts 49, 50 respectively, as illustrated in FIG. 2. In smaller rollers, only two bores are used in each journal shaft, the number of bores varying according to the number of wires that are needed.

Figure 3:
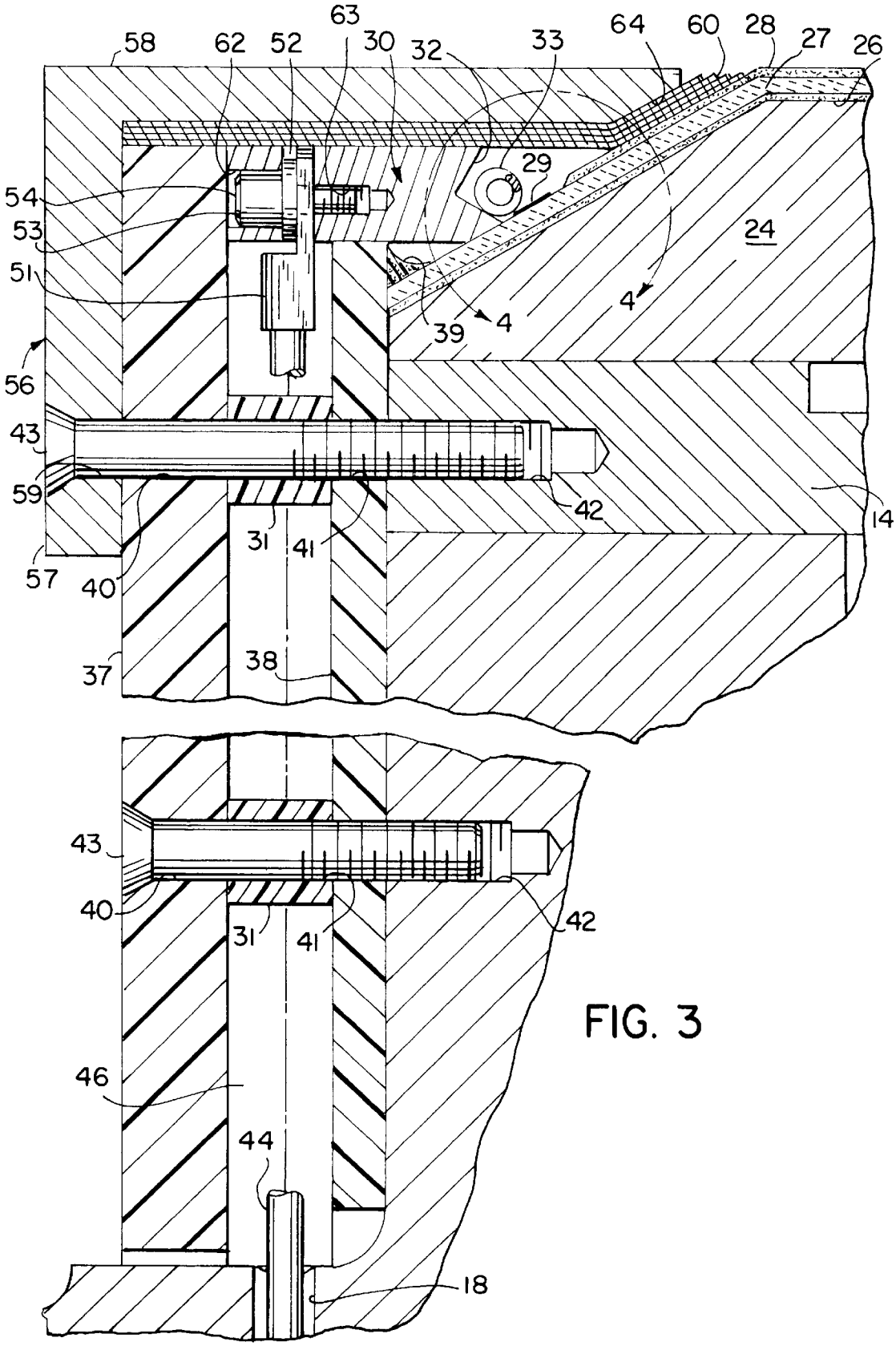
FIG. 3 is an enlarged, detail sectional view of a portion of FIG. 1.

As seen in FIGS. 1 and 3, the outer sleeve 11 of the core has a generally cylindrical middle portion 23 and tapered end portions 24, 25 at respective ends, each having a diameter that decreases at a constant slope, as seen in longitudinal section in FIGS. 1 and 3, from the middle portion 24 to an end face at each extremity to provide what is referred to as a "single bevel" with respect to the middle port ion 24.

Referring to FIG. 3, the roller 10 has a bond layer (not shown) formed over the outer core sleeve 11, a lower insulating layer 26, and a conductive heating layer 27 formed of a ceramic material as disclosed in U.S. Pat. No. 5,616,263. An outer insulating ceramic layer 28 is formed over the ceramic heating layer 27, but it does not extend completely over the entire end portions 24, 25, leaving a portion of the heating layer 27 exposed.

The contact assembly of the present invention includes a first electrical contact which is provided by a contact band 29 of a nickel alloy such as Metco 450 or Metco 480. This material is thermally sprayed over the heating layer 27 to reduce contact resistance. The contact band 29 is normally one to two mils thick and at least one-quarter inch wide and encircles each tapered end 24, 25 of the roller 10 at least one-quarter inch inward from the extremity. The thickness of the band 29 can be as little as 0.5 mils or as much as 6 mils thick. It is difficult to apply a band thinner than 0.5 mils and a band thicker than 6 mils does not provide a reliable interface especially at higher current levels. Arcing may occur between the band 29 and the heating layer 27.

The contact assembly of the present invention includes a second electrical contact, which is provided by an annular metal ring 30. The electrode ring 30 is made of metal and machined from sheet, tube or bar stock or bent into a ring from flat stock. Metals such as steel are plated for protection against corrosion. The ring 30 is sized in cross section to carry the maximum roller current without excessive heating. The ring in FIG. 1 was machined from a one-half inch thick steel plate, and is about one-quarter inch thick and one-half inch wide. In other embodiments, an alternative preferred metal is brass. The electrode ring 30 is not forced against the roller 10 or the contact band 29, but is simply held in position by an outer insulating, disk-shaped member 37. A bottom edge of the ring 30 abuts the conductive heating layer 27 below the contact band 29, but could in other embodiments touch the band 29 without impairing the operation of the contact assembly. The ring 30 has a groove 32 formed in it for receiving a portion of a spring 33 to be described below. The surface of the groove, where it makes contact with the spring 33, is at an angle equal and opposite, compared to the roller axis 17, to that of the tapered end of the roller. This feature causes the spring 33 to have equal, or nearly equal, contact pressure against the band 29 on the roller and the electrode ring 30. The spring 33 must have clearance around it so that its movement is unrestricted.

A contact spring 33 (FIGS. 3, 4 and 5) extends around each tapered end portion 24, 25 of the roller 10 in a location in which said contact spring 33 is interposed between and contacts both the contact band 29 and the electrode ring 30 to form a portion of the electrical circuit which extends through the conductive heating layer 27.

The spring 33 has a longitudinal axis 34 (FIG. 4) extending the length of the spring and the spring forms a plurality of coils 35 around said longitudinal axis 34. The coils 35 form a diameter from about one-sixteenth inch to about one-quarter inch. The spring 33 is made of a material, typically stainless steel, which in coiled form is stretchable and elastic and which retains its elasticity even at the operating temperature of the roller 10. The material is low enough in resistance and provides sufficient contact with the contact band 29 to prevent overheating due to very limited point contacts. The spring 33 overcomes the problems of misalignment and dimensional variations in solid contacts. The spring 33 has at least ten coils per inch, and in this example, has forty coils 35 per inch of length. The current carrying capacity of the contact band 29 (about 2 amps/inch in this example) is divided by the number of coils per inch so that each coil carries about 0.05 amps of current. The spring 33 has tapered coils 36 (FIG. 5) at one end to be received, or "screwed into" the coils 35 of an opposite end to hold the spring 33 in an annular position around the tapered end portion 13 of the roller 10. The tapered coils 36 provide a nearly uniform surface of coils in the area of the connection improving the uniformity of electrical contact in this area. This type of spring, known as a garter extension spring, is commercially available. The spring 33 exhibits extension or stretching an amount which is ten percent of its length in response to six to seven ounces of pull for a one-eighth inch diameter spring. The force required to pull the spring away from its contact with the contact band 29 is about six ounces for a 3.5-inch diameter roller and about two ounces for a twelve-inch diameter roller, and can be as little as one ounce. This compares to a force of about five pounds per linear inch of electrode circumference in one prior art design. Such large forces can damage the ceramic if the electrode ring in the prior art design is misaligned.

Even at a low level of spring tension, such as one ounce, sufficient electrical contact is maintained. To keep the same level of tension on even larger rollers, the present stretch in the spring 33 must be increased. For adequate electrical contact, even as few as ten coils 35 per inch is sufficient. Higher numbers of coils 35 per inch are beneficial and decrease the electrical stress on each coil 35 and contact point.

The angle of the surface on the annular contact member 30, where it contacts the spring 33, is a consideration. To provide the maximum ability of the spring 33 to maintain contact between the band 29 and the electrode ring 30, the spring 33 should contact the electrode ring at an angle equal and opposite to the angle of the taper on the roller 10. This is normally thirty degrees to the axis 17 of the roller 10. This provides an equal amount of contact force from the spring 33 to either the band 29 or the electrode ring 30. Other angles on the electrode ring 30 where it contacts the spring 33 will work also. The angle on the electrode ring 30 can be as low as five degrees or as high as eighty-five degrees, with the nominal figure at thirty degrees. There is some slope on the electrode surface to allow the spring to center itself between the contact surfaces on the band 29 and electrode 30. The minimum slope depends on the angle of the roller taper.

The electrode ring 30 is held in place by two insulating disk-shaped members 37, 38 (FIGS. 2, 3). The inner insulating member 38 is made of an electrical insulating material such as phenolic and supports and positions the electrode ring 30. This member 30 is typically one-eighth to one-quarter inch in thickness. A bead of flowable electrical insulating material 39 (FIG. 3) for operation at high temperature, such as silicone rubber, is applied in a groove formed where the beveled end portion 24 abuts the inner insulating member 37. The material 39 cures in place, and then helps seal this joint and prevent arcing between electrode ring 30 and the core 11 which is grounded as described below.

An outer member 37 of insulating material having a greater diameter than member 38, provides additional thermal insulation and positions the electrode ring 30 against the roller at the contact band 29. The outer insulating member 38 shields the electrode ring 30 and its connections to wires 44 illustrated in FIGS. 2 and 3.

The insulating members 37, 38 have holes 40, 41 positioned around an outer circle (eight locations a–h) defined by sleeve member 14 (FIG. 2) and an inner circle (four locations i, j, k, l). Threaded fastening bolts 43 are inserted through the holes 40, 41 in these locations into threaded holes 42 in the core of the roller 10. The bolts fit through insulating sleeves 31, which are positioned between the insulating members 37, 38 to complete insulation of each bolt 43 from the electrode ring 30. The thickness of the insulating sleeves or spacers 31 also positions the electrode ring 30 with respect to the tapered end of the roller 10. The fastening bolts 43 and the roller core 11, 12, 13 and 14 are connected to an electrical ground connection.

An external power supply 70 (FIG. 1) is connected to the heating layer 27 through four wires 44 carrying AC voltage at 120 V, 240 V or 480 V and through four ground wires 45. The four wires 44 from one side of the power supply 70 run through passageway 16 in journal shaft 49 and through bores 18 and space 46 (FIG. 3) in between insulating members 37, 38 to connections to electrode ring 30 (FIG. 2). The four wires 45 from the other side of the power supply 70 run through the passageway 16 to bores 19 in journal shaft 50 and then through passageway 47 (FIG. 3) to connections to a right end electrode ring 48 (FIG. 1) of a configuration like electrode ring 30 (FIG. 1).

The connection of one of the wires 44, 45 (FIG. 2) which connects the external power supply 70 (FIG. 1) to a heating circuit in the roller 10 is shown in FIG. 3. Each of the wires 44, 45 has an insulation jacket and a U-shaped or eye connector 51 which is crimped onto an end of the wire 44, 45 on which the insulation is either stripped or penetrated by metal points of the connector 51. The electrode rings 30, 48 have slots 52 for receiving the connectors 51 and a washer 53 for holding down each connector 45 when a socket-headed bolt 54 is inserted through a bored hole 62 in electrode ring 30, 48 that communicates with the slot 52. The bolt 54 is secured in a threaded hole 63 in electrode ring 30, 48.

The end cap assembly is completed by an end cap 56 (FIG. 3), normally made of metal, which may extend down to a roller journal 49. The end cap 56 includes an end wall 57, and a side wall 58 that extends up the length of the roller 10 to the point where the tapered end portion 24 extends from the middle portion 23 of the roller 10. The end cap 56 includes bored holes 59 (FIG. 3) for receiving fastening bolts 43 on the outer circle shown in FIG. 2. The end cap 56 is insulated from the metal electrode ring and wiring connections by one or more layers of an insulation material 60 (FIG. 3), preferably a Teflon-coated tape, extending along the inside of the side wall 57. The tape covers the edges of the insulating members 37 and the sides of the electrode ring 30. The end cap 56 projects inwardly toward a region where the tapered end portion 24 begins to taper from an untapered middle portion 23 of the roller, the end cap 56 having a surface 64 angled generally parallel to the tapered end portion 24. The layer of insulation 60 insulates the angled surface 64 of the end cap 56 from the tapered end portion 24 of the roller 10 by filling the space between end cap 56 and the outer layer 28 of the roller 10.

Figure 6:
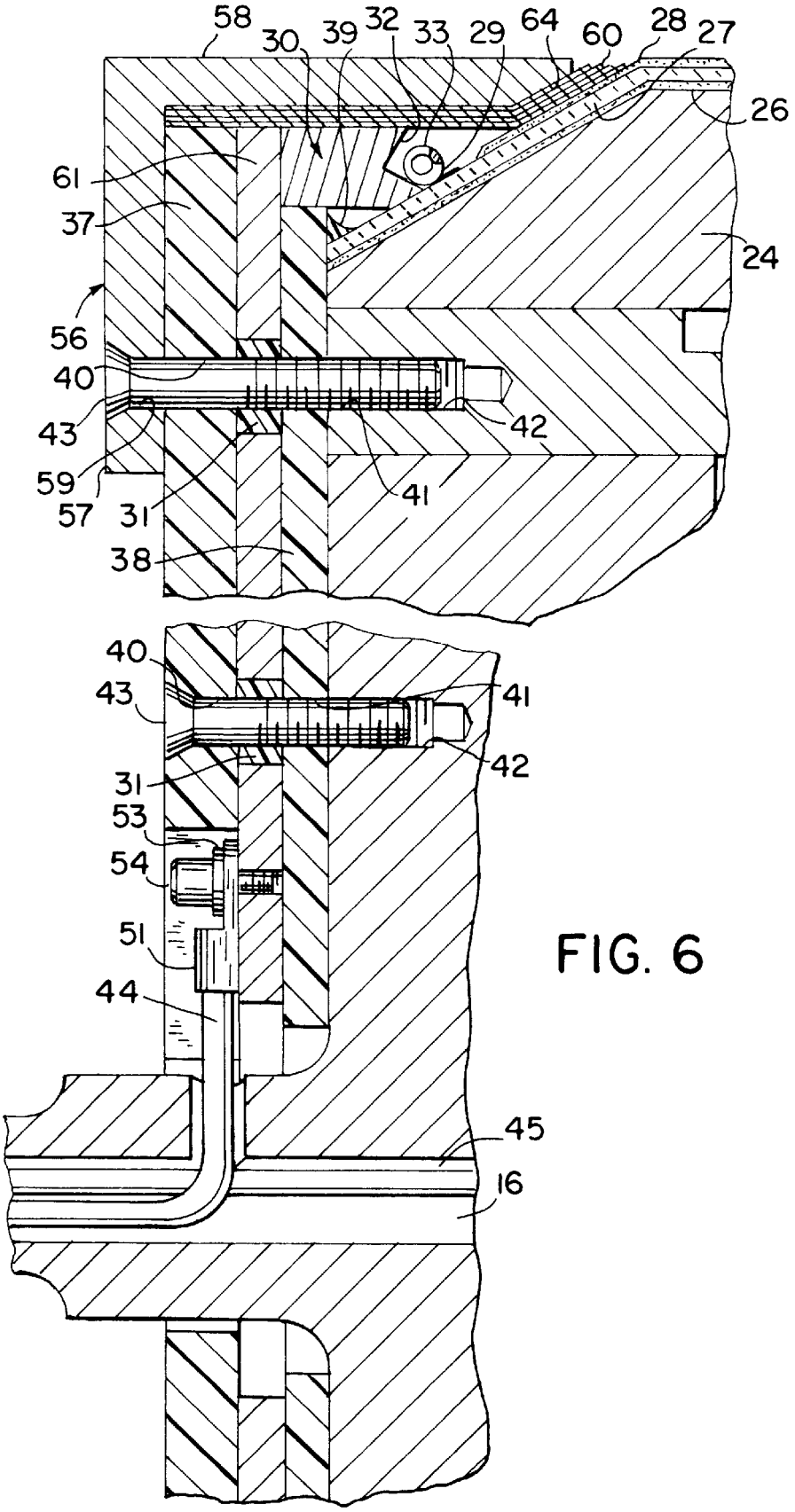
FIG. 6 is an enlarged, detail view showing an alternative to the embodiment of FIG. 3.

FIG. 6 shows the same preferred embodiment of a contact assembly 29, 30, 33 of the present invention, having a different manner of connecting electrode rings 30, 48 to the external power supply 70. In FIG. 6, parts which are the same as parts in FIGS. 1–5 have the same number. Parts which are of different construction have been given new numbers. In FIG. 6, the wires 44, 45 and their connections to the electrode rings 30, 48 are replaced by conductive members 61, preferably of metal, those members 61 being shown for the left end in FIG. 6. Such members 61 would be trapped against the back side of electrode ring 30, 48. The conductive members 61 can be disk-shaped for contact around the electrode ring or can be elongated members replacing wires 44 in FIG. 2. Such members 61 have holes to allow passage of insulating sleeves 31 and fastening bolts 43, which are connected to ground. At the lower end, wires 44 would again connect via cap screw 54, washer 53 and wire connector 51 to the solid conductive members 61. Similar connections would be made at the opposite end of the roller 10 to wires 45 returning to the power supply 70.

This has been a description of examples of how the invention can be carried out. Those of ordinary skill in the art will recognize that various details may be modified in arriving at other detailed embodiments, and these embodiments will come within the scope of the invention.

Therefore, to apprise the public of the scope of the invention and the embodiments covered by the invention, the following claims are made.

We claim:

1. An electrical contact assembly for forming a portion of an electrical circuit that includes a heating layer in a roller, wherein said roller has a generally cylindrical middle portion and at least one tapered end portion tapering from wider to narrower as said end portion extends to an extremity of said roller; and wherein the electrical contact assembly comprises:

a first electrical contact disposed on said tapered end portion of said roller, said electrical contact being electrically connected to said conductive heating layer;

an annular contact structure assembled to the roller with at least a second electrical contact for forming a portion of the electrical circuit which includes the conductive heating layer of the roller; and a stretchable elastic contact member for extension around the tapered end portion of the roller in a location in which said contact member makes bridging contact from the first electrical contact to the second electrical contact to form the portion of the electrical circuit which includes the conductive heating layer; and wherein said first electrical contact and said second electrical contract form angled side portions of a V-shaped trough in which said stretchable electrical contact member is received.

2. The electrical contact assembly of claim 1, wherein said stretchable elastic contact member is an extension spring having a longitudinal axis extending the length of the spring and wherein said extension spring forms a plurality of coils around said longitudinal axis.

3. The electrical contact assembly of claim 2, wherein said coils have a diameter from about 1/16 inch to about 1/4 inch, inclusive.

4. The electrical contact assembly of claim 3, wherein said spring provides at least 10 coils per inch of length.

5. The electrical contact assembly of claim 1, wherein said stretchable elastic contact member is an extension spring and wherein prior to assembly said extension spring has coils of decreasing diameter at one end to be received in coils of greater diameter at an opposite end to hold the extension spring in an annular position around the tapered end portion of the roller.

6. The electrical contact assembly of claim 1, wherein said first contact is formed by a metal band of a nickel alloy.

7. The electrical contact assembly of claim 6, wherein said metal band is thermally sprayed to reduce contact resistance to the heating layer.

8. The electrical contact assembly of claim 7, wherein said metal band is from 0.5 to 6 mils in thickness and at least 0.25 inches in width, and is located inwardly at least 0.25 inches from the extremity of the roller.

9. The electrical contact assembly of claim 1, wherein said roller has a longitudinal axis and a middle portion formed substantially parallel to said axis and wherein said tapered end portion tapers along a single bevel with respect to the middle portion of the roller.

10. The electrical contact assembly of claim 1, wherein said tapered end portion tapers along a single bevel with respect to said middle portion at an angle from approximately five degrees to approximately eighty-five degrees.

11. The electrical contact assembly of claim 1, wherein said tapered end portion tapers along a single bevel with respect to said middle portion at an angle of approximately 30 degrees.

12. The electrical contact assembly of claim 1, wherein the annular contact structure further comprises an outer metal ring, an inner metal contact ring which includes the second electrical contact, and an insulating supporting structure which supports the inner metal contact ring, and a layer of insulation which insulates the outer metal ring from the inner metal contact ring.

13. The electrical contact assembly of claim 12, wherein said outer metal ring projects inward toward a region where the tapered end portion begins to taper from an untapered middle portion of the roller, said outer metal ring having a angled surface angled generally parallel to said tapered end portion and wherein said layer of insulation also insulates said angled surface of the outer metal ring from the tapered end portion of the roller.

14. The electrical contact assembly of claim 12, wherein the roller includes a core and wherein the outer metal ring is connected by fasteners into one end of the roller core, said fasteners being insulated from said inner metal contact ring and which is electrically connected to ground along with the outer metal ring and the roller core.

15. The electrical contact assembly of claim 12, wherein the inner metal contact ring is connected through at least one wire to an external power supply.

16. The electrical contact assembly of claim 12, wherein said insulating supporting structure includes two spaced members of insulating material and wherein the inner metal contact ring is connected to an external power supply through a metal member that is interposed between said two spaced members of insulating material.

17. The electrical contact assembly of claim 1, wherein a flowable body of insulating material is positioned around the tapered end portion of the roller in a groove formed where the extremity of the roller abuts the annular contact structure, and wherein said body of insulating material is allowed to cure in place in a position where it insulates the first and second contacts from other portions of the roller.

18. The electrical contact assembly of claim 1, wherein said first electrical contact and said second electrical contact are spaced apart and do not contact one another.

19. An electrical contact assembly for forming a portion of an electrical circuit that includes a heating layer in a roller, wherein said roller has a generally cylindrical middle portion and at least one tapered end portion tapering from wider to narrower as said end portion extends to an extremity of said roller; and wherein the electrical contact assembly comprises:

a first electrical contact disposed on said tapered end portion of said roller, said electrical contact being electrically connected to said conductive heating layer;

an annular contact structure assembled to the roller with at least a second electrical contact for forming a portion of the electrical circuit which includes the conductive heating layer of the roller;

a stretchable elastic contact member for extension around the tapered end portion of the roller in a location in which said contact member makes bridging contact from the first electrical contact to the second electrical contact to form the portion of the electrical circuit which includes the conductive heating layer; and wherein said elastic contact member contacts a surface of the annular contact structure, the annular contact structure having an angle which is equal and opposite to the angle of taper on the end of the roller compared to an axis of the roller.

20. The electrical contact assembly of claim 19, wherein the surface of the annular contact structure that contacts the spring, is positioned at an angle of approximately thirty degrees in relation to the axis of the roller.

21. The electrical contact assembly of claim 19, wherein the surface of the annular contact structure that contacts the spring, is between about five degrees and about eighty-five degrees in relation to the axis of the roller.

22. The electrical contact assembly of claim 1, wherein the electrical conductivity of the annular contact structure and the elastic contact member are selected to prevent excessive heating due to current flowing through the electrical circuit that includes a heating layer in a roller.

23. The elastic contact member of claim 1, wherein the force required to pull the elastic contact member away from the first and second electrical contacts is in a range from at least one ounce to no more than sixteen ounces.

24. The electrical contact assembly of claim 19, wherein the stretchable elastic contact member has a plurality of coils, and wherein coils make the bridging contact around a portion of their circumference and wherein such portion is less than ½ of said circumference to limit a length of a current path between the first electrical contact and the second electrical contact.

25. The electrical contact assembly of claim 1, characterized in that the second electrical contact that contacts the spring, is positioned at an angle of approximately thirty degrees in relation to the axis of the roller.

26. The electrical contact assembly of claim 1, wherein the second electrical contact that contacts the spring, is oriented between about five degrees and about eighty-five degrees in relation to the axis of the roller.

27. The electrical contact assembly of claim 1, wherein the stretchable elastic contact member has a plurality of coils, and wherein coils make the bridging contact around a portion of their circumference and wherein such portion is less than ½ of said circumference to limit a length of a current path between the first electrical contact and the second electrical contact.

* * * * *